US005536109A

United States Patent [19]

Lowndes

[11] Patent Number: 5,536,109

[45] Date of Patent: Jul. 16, 1996

[54] ROAD VEHICLE HALTING DEVICE

[76] Inventor: Roy B. W. Lowndes, 8 Gordon Court, Victoria Road Stechford, Birmingham, West Midlands B33 8AN, United Kingdom

[21] Appl. No.: 412,243

[22] Filed: Mar. 28, 1995

[51] Int. Cl.[6] ..... E01F 13/00

[52] U.S. Cl. ..... 404/6; 404/9; 256/1; 256/13.1

[58] Field of Search ..... 404/6, 9; 256/1, 256/13.1

[56] References Cited

U.S. PATENT DOCUMENTS

| | | | |
|---|---|---|---|
| 4,995,756 | 2/1991 | Kilgrow et al. | 404/6 |
| 5,253,950 | 10/1993 | Kilgrow et al. | 404/6 |

FOREIGN PATENT DOCUMENTS

| | | | |
|---|---|---|---|
| 567707 | 10/1975 | Switzerland | 404/6 |
| 322224 | 12/1929 | United Kingdom | 404/6 |
| 1480331 | 7/1977 | United Kingdom | 404/6 |
| 2183702 | 6/1987 | United Kingdom | 404/6 |
| 2187491 | 9/1987 | United Kingdom | 404/6 |

*Primary Examiner*—Michael P. Buiz
*Assistant Examiner*—Pamela A. O'Connor
*Attorney, Agent, or Firm*—Arnold B. Silverman; Alan G. Towner; Eckert Seamans Cherin & Mellott

[57] ABSTRACT

A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that in the event of a vehicle driving over the device, at least one of the formations digs into the ground.

25 Claims, 5 Drawing Sheets

Figure 1:
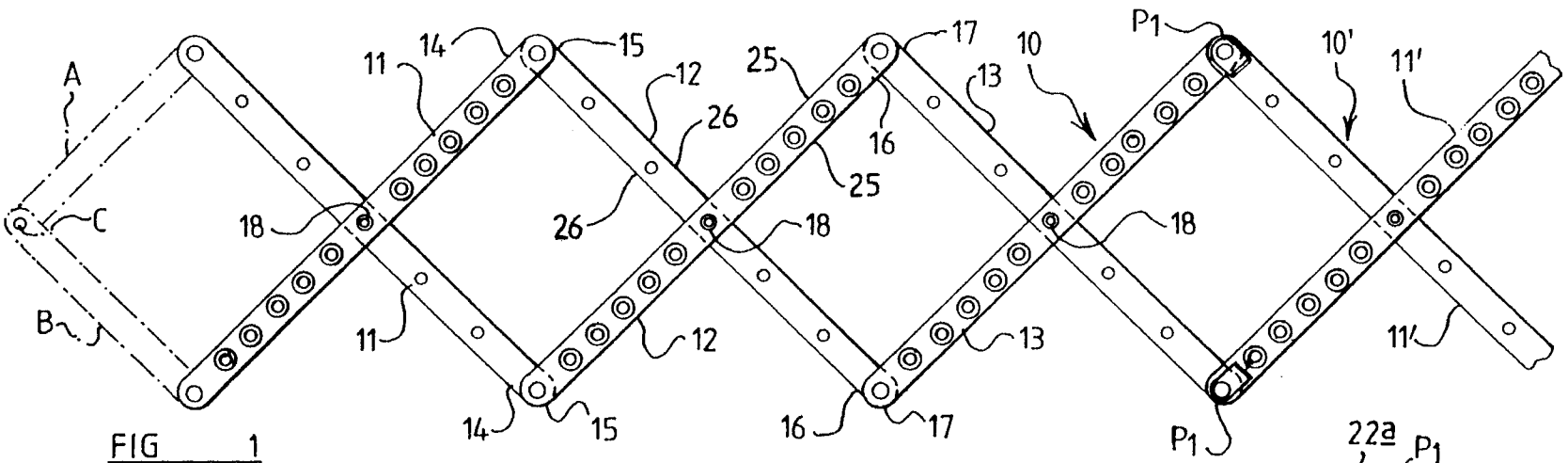

FIG 4
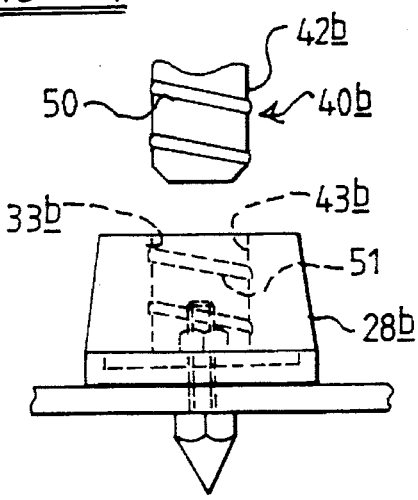
FIG 5
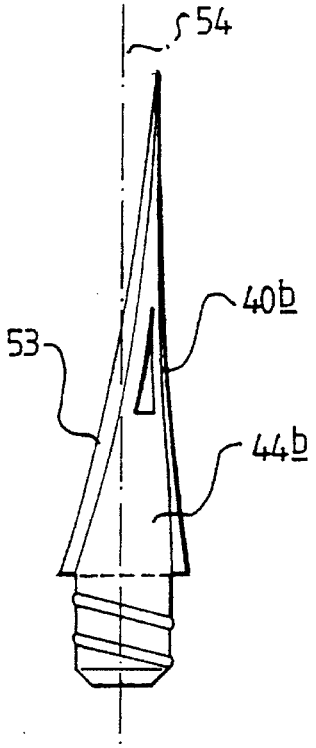
FIG 6
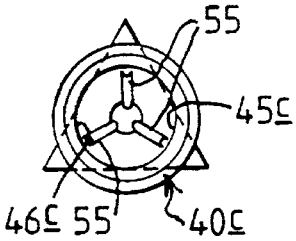
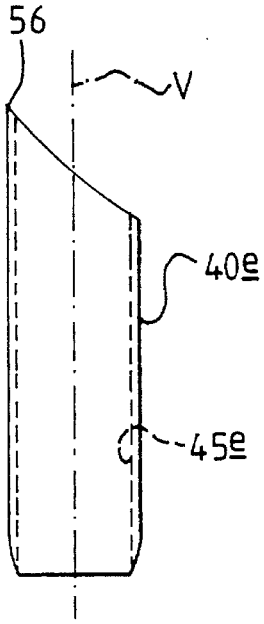
FIG 8
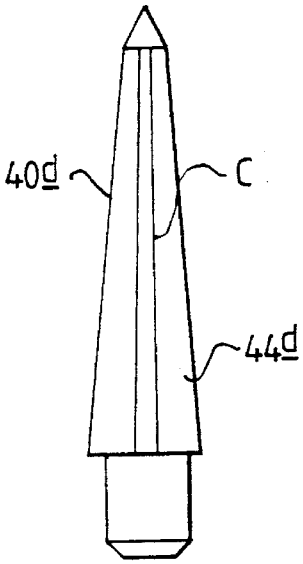
FIG 7

FIG 12
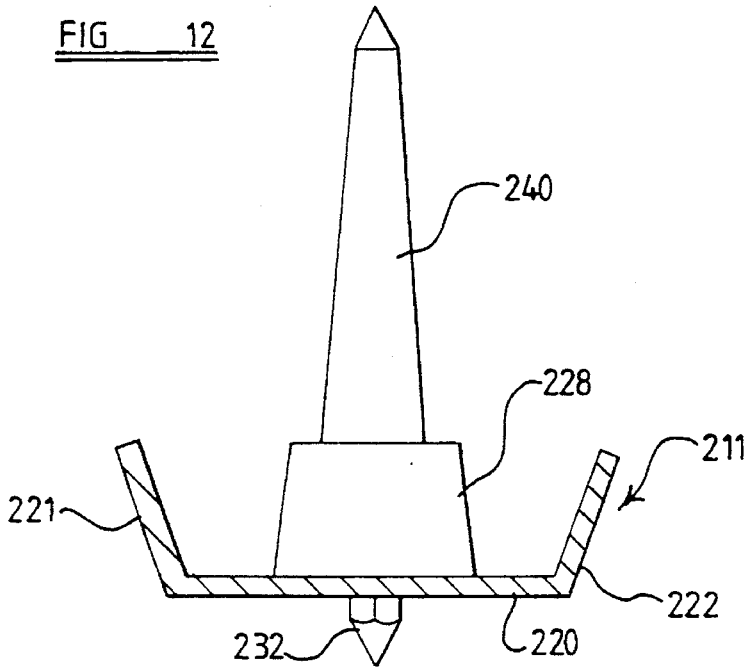
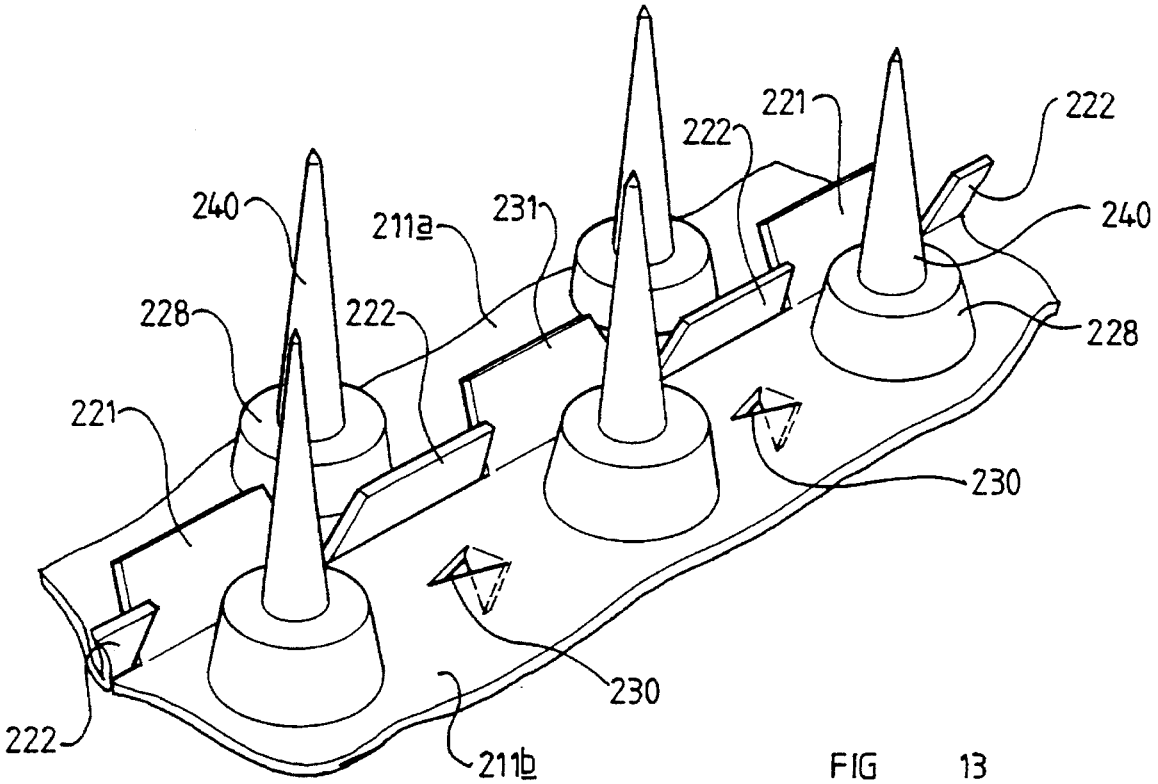
FIG 13

ROAD VEHICLE HALTING DEVICE

DESCRIPTION OF THE INVENTION

This invention relates to a road vehicle halting device.

One such device is described in my previous Patent No. GB 1480331 in which a support carries a plurality of generally conical spikes which are releasable from the support as a vehicle is driven over the device and a vehicle wheel impinges upon the spikes, whereby the tyres of the vehicle are punctured and the vehicle is constrained to come to a halt.

According to one aspect of the invention I provide a road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that in the event of a vehicle driving over the device, at least one of the formations digs into the ground.

It has been found with known devices that when a vehicle is driven over the device, notwithstanding that the road vehicle may be halted, undesirably the device may be moved along and/or across the road unless it is fixed relative to the road. Hence the device may prove inefficient in halting a second vehicle which is driven behind the first mentioned halted vehicle, because of the mispositioning of the device.

Particularly where the device is used as a road block, it is desirable for the device readily to be foldable to the closed condition to allow vehicles to pass through the road block. Hence it is not always desirable permanently to fix the device to the road.

In accordance with the invention, in the event of a vehicle being driven over the device, the downwardly extending formations dig into or otherwise fix the device relative to the ground to prevent or at least lessen the likelihood of movement of the device over the road surface.

According to a second aspect of the invention I provide a road halting device comprising a member having a plurality of support elements each supporting a generally upwardly extending spike, the support elements each comprising a cup moulded in a plastics material and having a washer embedded in the plastics material.

According to a third aspect of the invention I provide a road vehicle halting device comprising a member having a plurality of support elements each supporting a generally upwardly extending spike, the support elements each comprising a cup, the cups and spikes having interengaging threaded formations so that the spikes are screwed into and out of their respective cups.

According to a fourth aspect of the invention I provide a road halting device comprising a member having a plurality of support elements each supporting a generally upwardly extending spike, at least some of the spikes extending upwardly from their respective support elements at an angle to the vertical.

According to a fifth aspect of the invention I provide a road vehicle halting device comprising a member having a plurality of support elements each supporting a generally upwardly extending spike, wherein at least some of the support elements are attached to the device by respective fasteners each of which includes a nut, and the respective spikes including formations which co-operate with the nuts whereby the spikes are supportable by their support elements only in one or more specific axial orientations.

According to a sixth aspect of the invention I provide a road vehicle halting device comprising a member having a plurality of support elements each supporting a generally upwardly extending spike, wherein the spikes each include a non-round extending wall part e.g. square which co-operates with a corresponding non-round hollow of its respective support element.

According to a seventh aspect of the invention I provide a road vehicle halting device comprising a member having a plurality of support elements each supporting a generally upwardly extending spike, wherein the spikes each comprise a cylinder which is hollow and has a sharpened tip.

According to an eighth aspect of the invention I provide in combination a device according to any one of the first to the seventh aspects of the invention and a deployment apparatus comprising a chamber in which the device is received in a closed condition, the chamber having a mouth through which the device can be extended.

According to a ninth aspect of the invention I provide a road vehicle halting device comprising first and second generally elongate end arm members and at least one generally elongate intermediate arm member, the or each intermediate arm member being connected by pivotal connections at or adjacent each of its ends to two further of the arm members whereby the device is extendable from a closed condition in which the arm members all lie generally alongside one another to an open condition when at least some of the arm members lie transverse to one another, the device further comprising a plurality of support elements each supporting, in use, a generally upwardly extending spike.

Figure 1A:
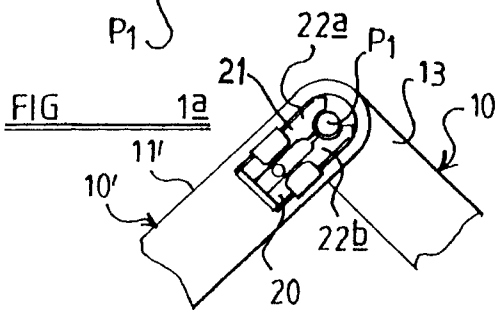
Figure 3:
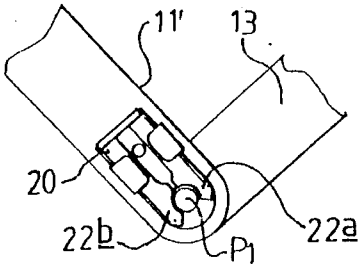
Figure 2:
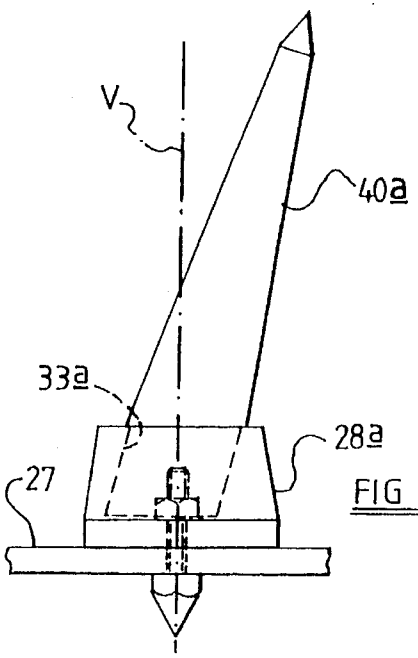
Figure 2:
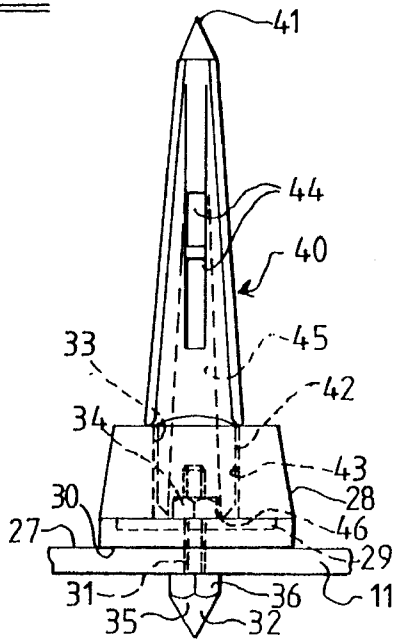
Figure 9:
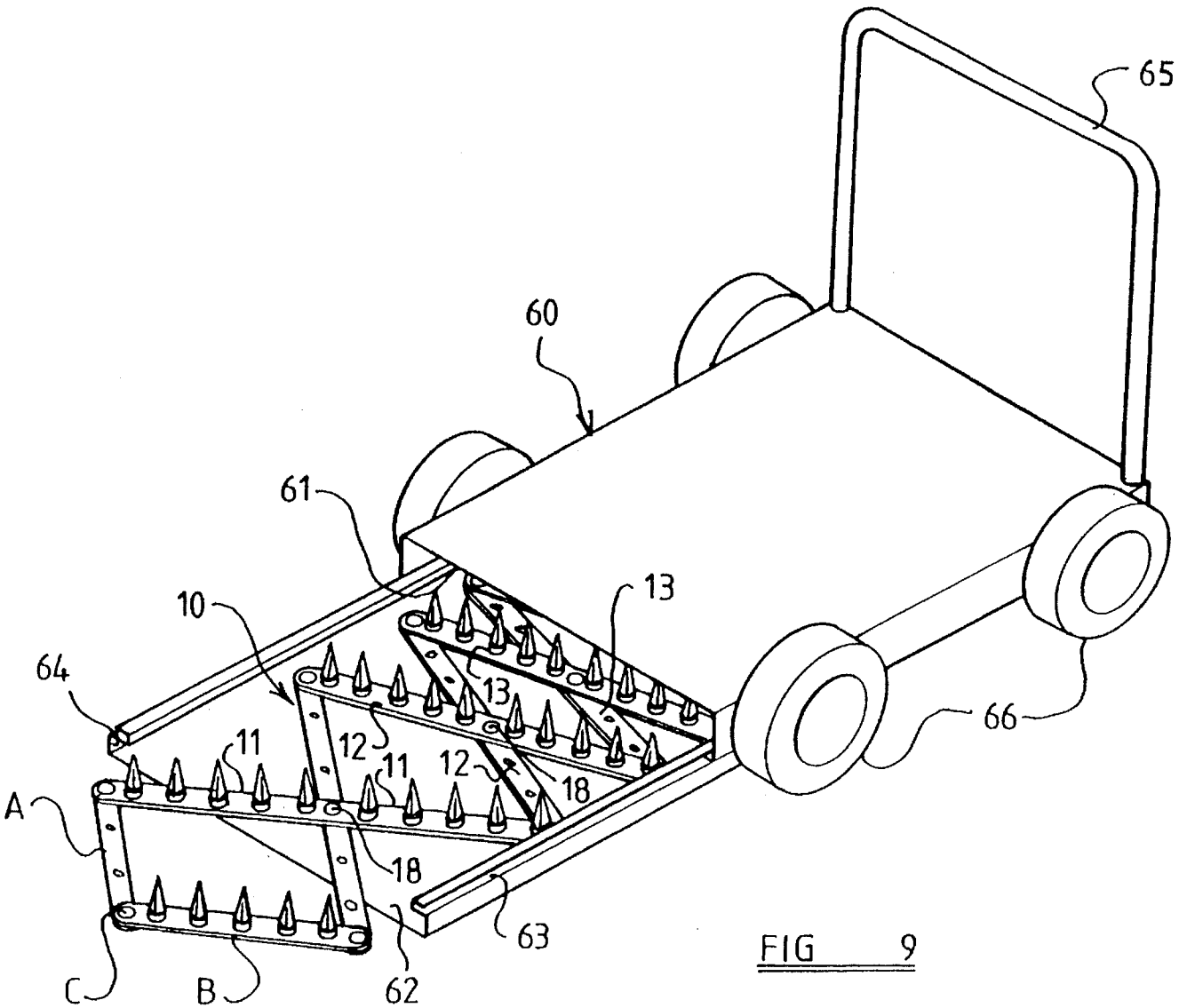
Figure 10:
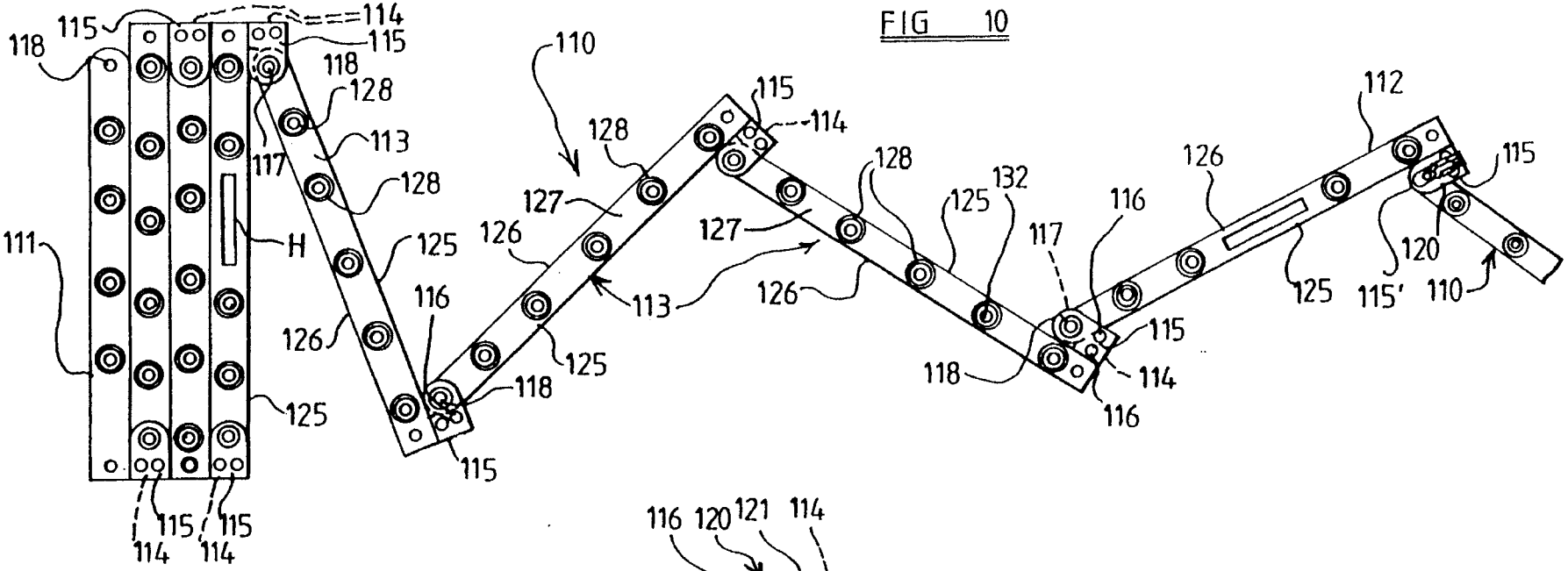
Figure 11:
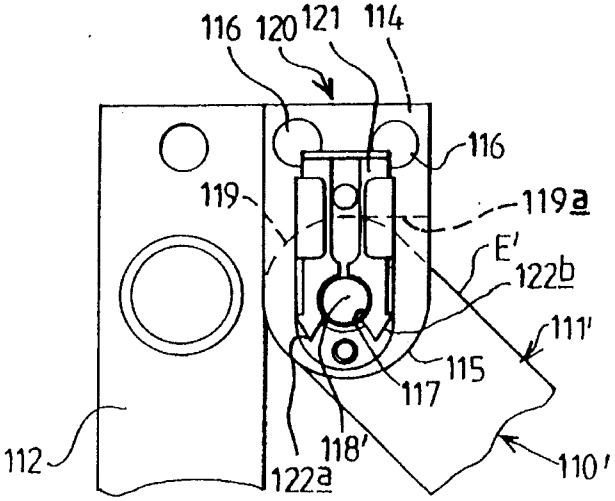

The invention will now be described with reference to the accompanying drawings, in which:

FIG. 1 is a plan view of a road vehicle halting device in accordance with the invention shown in an extended condition, and shown connected to a further device in accordance with the invention, FIG. 1*a* is an enlarged view of one part of the device of FIG. 1, FIG. 2 is an enlarged side view of another part of the device of FIG. 1 showing a spike and support element, FIG. 3 is a view similar to FIG. 2 but of a modified arrangement, FIG. 4 is a view similar to FIGS. 2 and 3, but of an alternative arrangement and showing the spike separated from its support element, FIG. 5 is a side view of another spike for use with a device in accordance with the invention, FIG. 6 is an underside plan view of a spike for use with the device in accordance with the invention, FIG. 7 is a view similar to FIG. 5 but of a yet still further spike, FIG. 8 is a view similar to FIGS. 5 and 7 but of a yet still alternative spike, FIG. 9 is a perspective view showing a deployment apparatus for deploying the device according to the invention, FIG. 10 is a plan view of another embodiment of a road halting device in accordance with the invention shown partly in a closed condition, partly in an open condition, and shown connected to a further device in accordance with the invention, FIG. 11 is an enlarged view of one part of the device of FIG. 1.

FIG. 12 is an enlarged end cross section through a modified arm member which may be used for the devices of FIG. 1 or FIG. 10 if desired, FIG. 13 is an enlarged fragmentary view of two adjacent arm members of FIG. 12, side by side, when the road halting device is in a folded condition.

Referring to FIG. 1 of the drawings, there is shown a road vehicle halting device 10 comprising a first pair of generally elongate arm members 11, each arm of which is connected at one end 14 to the end 15 of a respective arm member 12 of a second pair of arm members, the other ends of the arm members 16 of the arm members 12 of which are each in turn pivotally connected to the end 17 of a respective arm member 13 of a third pair.

The arms 11 of the first pair are also pivotally interconnected intermediate their ends (at 18) as are the arms 12 of the second pair and the arms 13 of the third pair, such that the device 10 comprises a "lazy tong" arrangement.

As shown, the arm members 13 of the third pair of the device 10 are pivotally connected to arms 11' of a further device 10' which is of substantially identical construction to device 10, but could be of a different length i.e. having a different number of pairs of connected arm members 11–13 as desired.

The ends 14,15,16,17, of the arm members 11–13 are all rounded, and have respective pivot pins 19 connecting them together to permit the arm members 11 to 13 to pivot relative to one another from a closed condition in which the pivots 18 connecting the arms 11–13 of the pairs are all at a closest together position, to an extended condition as shown.

However, the amount of relative pivoting as the device is extended is restricted by a suitable stop means.

For example, the arm members 11–13 may be provided with formations extending upwardly or downwardly from the general planes of the arm members 11–13 which abut when the arm members 11–13 are in preferred transverse relationship to the next adjacent arm member 11–13 i.e. when the device is open to its fullest extent.

The arm members 13 each have a pivot pin P' at the end opposite to end 17, which pin P' is adapted to be gripped by a clip 20 (see FIG. 1*a*) provided on the end of arm member 11' of the device 10' to permit the devices 10,10' to be connected together. Any desired number of devices 10,10' can thus be connected together to provide to a road vehicle halting apparatus of any desired extent.

The clips 20 each comprise a sliding part 21 including a pair of resiliently biased arms 22*a*,22*b*, which are adapted to be engaged around a pivot pin P'. The pivot pins P' preferably each having a groove in which the edges of the arms 22*a*,22*b*, are received.

One of the arm members of each of the pairs of arm members 11 to 13 has attached to an upper surface 27 thereof, a plurality of support elements comprising cups 28 as shown in FIG. 2. The cups 28 are moulded from a suitable plastics material, and each has embedded within the plastic material, a washer 29 adjacent a base 30 of the cup 28, to give rigidity to the connection between the cup 28 and the respective arm member 11 to 13.

The arm members 11 to 13 each have an opening 31 through which a threaded fastener 32 passes, into a hollow 33 of the cup 28. A nut 34 is received on the threaded fastener 32 to thus attach the cup 28 to the respective arm member 11 to 13.

The fastener 32 in the present example has a head comprising a downwardly extending spike 35, for a purpose hereinafter explained, as well as flats 36 to facilitate gripping the fastener 32 as the nut 34 is tightened.

Received within and extending from each of the hollows 33 of cups 28, is a spike 40 which is made of metal, and has a sharpened tip 41. The spike 40 is retained releasably within the hollow 33 of the cup 28 by virtue of frictional engagement between an external wall part 42 of the spike 40, and an internal boundary wall 43 of the hollow 33 of the cup 28.

If desired, the others of the arm members of each of the pairs of arm members 11–13 has one or more openings to receive fasteners by which the device 10 may be fixed to the ground.

Also, if desired, as shown in dotted lines in FIG. 1, end arm members A,B, may be pivotally connected to the arm members 11, to provide a convenient end to the device, the end arm members A,B, being mutually pivotally connected at their free ends at C.

In use, the device 10 is laid across a road in an extended condition with the spikes 40 extending upwardly, and the spikes 35 of fasteners 32 extending downwardly into engagement with the ground. In the event that a vehicle is driven over the device 10, and a tyre of the vehicle impinges upon a spike 40, the spike 40 will be removed from its cup 28 and become embedded in the vehicle tyre as the tyre rotates. This is possible because of the pointed tip 41 of the spike 40 cuts its way into the tyre to cause a puncture. The compressed air from inside the tyre is released in a controlled manner by virtue of the spike 40 being hollow and there being openings such as shown at 44 from the external wall of the spike 40 into the hollow 45 thereof. The hollow 45 opens to the base 46 of the spike 40 and thus can pass from the spike 40 once the spike 40 has been released from its cup 28.

At the same time, the spikes 35 of fasteners 32 which extend downwardly from the device 10, will be driven into the ground, at least in the regions of the device where the vehicle wheels pass over the device 10. Thus any tendency for the device to migrate over the surface of the road is reduced.

For vehicles such as cars and lorries, the spikes 40 are preferably arranged to extend vertically as shown in FIG. 2. However, for a vehicle such as a motorbike, it is preferred for the spikes 40 to extend at an angle to the vertical towards the oncoming wheel, preferably at an angle to the vertical V of between 15° and 20° and at least an angle of 10° to the vertical V. In FIG. 3, there is shown a spike 40*a* which is similar in construction to the spike 40 of FIG. 2, but the spike 40*a* is received in a cup 28*a* in which the hollow 33*a* of the cup 28 is moulded at an angle to the vertical V so that the spike 40*a* extends in a desired direction i.e. preferably towards oncoming vehicles at an appropriate angle.

It is preferred that at least some of the spikes received in support elements of the device extend generally vertically as does spike 40 in FIG. 2, whilst only some of the spikes extend at an angle to the vertical as illustrated in FIG. 3. In this way, the device 10 is effective against different types of vehicle.

In both of the embodiments so far described, it will be appreciated that when a spike 40 or 40*a* becomes embedded in a vehicle tyre, the spike 40,40*a* is simply pulled from its support element 28,28*a*, overcoming any frictional force between the spike 40,40*a* and support element 28,28*a*.

In FIG. 4, a modified arrangement is shown in which an external wall part 42*b* of a lower part of a spike 40*b*, i.e. that part which is received within a cup 28*b* secured to any one of the arm members 11 to 13, is provided with a male threaded formation 50. The boundary wall 43*b* of the hollow 33*b* of the cup 28*b* is similarly provided with corresponding female threaded formation 51 so that the spike 40*b* has to be screwed into the hollow 33*b* of cup 28*b*.

The helix angles of the threaded formations 50 and 51 are preferably such that as the spike 40*b* is pulled relative to the cup 28*b* by virtue of being embedded in a vehicle tyre, this imparts a rotational movement to the spike 40*b* which thus causes it to be unscrewed from its cup 28*b* as it becomes embedded in the vehicle tyre.

If desired, the spike 40*b* may otherwise be constructed similarly to spikes 40. Alternatively a helical formation 53 may be provided on the external wall part 44*b* of the spike 40*b* which would first enter the vehicle tyre. In this way, as the spike 40*b* is driven home, the spike 40*b* is caused to rotate about a rotational axis 54.

In another arrangement shown in FIG. 6, instead of the spike being screwed into its respective cup, the spike shown at 40*c*, is a push fit. However, in an opening 45*c* of the spike 40*c*, which opens from the spike 40*c* at a base 46*c* thereof, there are provided three rib formations 55 which extend generally longitudinally within the spike 40*c* and are each adapted to engage with flats of a nut such as nut 34 of the fastener 32 seen in FIG. 2 so that the spike 40*c* is restrained from rotating at least until it has been pulled clear of its respective cup. Also of course, the spike 40*c* is only able to be fully received in its cup in particular axial orientations coinciding with where the formations 55 engage the flats of the nut.

In each of the embodiments so far described, the spikes 40–40*c* are generally pyramidal having three base sides, and are hollow and there are openings into the hollow to allow for the controlled release of compressed air from a vehicle tyre in which the spike has become embedded. In FIG. 7, there is shown a generally conical spike 40*d* which is essentially solid but is provided with one or more channels C cut into the external wall part of the spike 40*d* in the region of the wall part 44*d* which would enter the vehicle tyre, so as to allow air through the puncture caused by the spike 40*d* to pass along the channels C.

In FIG. 8, a spike 40*e* of an entirely different construction to the spikes 40–40*d* so far described is shown. The spike 40*e* is generally of cylindrical configuration, the top edge of the cylinder being cut at an angle to the vertical V as shown, to provide a pointed tip 56. It will be appreciated that the spike 40*e* shown in FIG. 8, when driven into the tyre of a vehicle, would cut a core in the tyre which would be blown from the inner hollow 45*e* of the spike 40*e* by the release of compressed air from within the tyre.

If desired, the spike 40*e* may be provided with an external helical formation such as the spike 40*b* of FIG. 5, and/or with a threaded formation which co-operates with a corresponding threaded formation of a cup, and/or with internal formations similar to formations 55 shown in FIG. 6.

Referring now to FIG. 9, there is shown a device 10 substantially as shown in FIG. 1, but may alternatively have any of the modifications or alternatives described with reference to FIGS. 2 to 8.

The device 10 is shown extending partly from a deployment apparatus 60 which comprises an internal chamber 61 in which the entire device 10 is receivable in a closed condition.

The apparatus 60 includes a handle 65, and rollers 66 to facilitate dragging the apparatus 60 over the ground whilst deploying or de-deploying the road vehicle halting device 10.

The device 10 itself is provided with a handle 65 which may, for example by attached to the free ends of arm members 11 or to the end arm members A,B, where provided or otherwise as desired.

The device 60 includes a drawer 62 which is received in runners 63 of the device 60 so that the drawer 62 and device 60 can slide from the chamber 61.

The drawer 62 itself has inturned guide means 64 to guide the arm members 11–13 of the device as they slide out of the chamber 61 and off the drawer 62 onto the ground.

The apparatus 60 is conveniently carried on a motorcycle and the device 10 may quickly be deployed by placing the apparatus 60 on the ground, and either pulling the device 10 from the apparatus 60 using the handle (not shown), whilst another person holds the handle 65 to prevent the apparatus 60 moving over the ground, or alternatively, by fixing the end member 12 relative to the ground, and pulling the apparatus 60 over the ground using the handle 65.

In either event, the device 10 may quickly be deployed as a temporary road block for example, or in other circumstances where it is desired to halt a vehicle by disabling the vehicle and hence causing it to come to a halt.

Various modifications may be made without departing from the scope of the invention.

The device 10 may be of any desired length, having any number of pairs of arm members 11–13 as desired.

Any desired number of support elements and spikes may be provided along each of the arm members 11 to 13 as are considered necessary.

Instead of providing fasteners 32, the heads of which have spikes 35, any other arrangement of downwardly projecting members which dig into or otherwise locate the device relative to the ground may be provided.

For example, if desired, the arm members 11–13 may have downwardly deformed portions e.g. at their edges 25,26 with serrated or tooth like parts, or the arm members 11–13 may be provided with rubber feet.

In each of the embodiments described, the spikes each have a generally cylindrical base which is received by a support element having a hollow of a corresponding shape.

If desired, the spikes may have a non-round base e.g. square, and the hollows of the support elements may be suitably shaped to receive the spikes.

Referring now to FIG. 10 of the drawings, there is shown a further embodiment of a road vehicle halting device 110 in accordance with the invention and comprising a pair of end arm members 111 and 112 and a plurality of (in this example six) intermediate arm members 113. Each of the arm members 111–113 is generally elongate and conveniently is made in a light strong material such as aluminium. The arm members 111 to 113 are pivoted at their ends in the manner shown so as to provide a device which may be moved from a fully closed position wherein each of the arm members 111 to 113 lie alongside one another in generally parallel fashion as are the arm members 113 immediately adjacent end arm member 111, and a fully open condition in which the arm members 111 to 113 extend transverse to one another, as are the arm members 113 immediately adjacent end arm member 112.

As shown, the device 110 is connected to a further device 110' which is of substantially identical construction to device 110, but could be of a different length i.e. having a different number of intermediate arm members 113 as desired.

Each of the arm members 111–113 comprises at one end, a tag 114 which extends generally transversely of the longitudinal extent of the arm member, and secured to the tag 114, is a mounting part 115. In the present example, the mounting parts 115 are secured to their respective tags 114 by rivets 116 so as to be rigid with the tag 114. The next arm member 113 has a pivot opening 117 in which is received a pivot pin 118 which secures the end of the next arm member below the mounting part 115, to the mounting part 115. All of the intermediate arm members 113 are constructed substantially identically but arranged alternately in opposite orientations. The ends of the arm member 111–113 opposite to the ends which are provided with the tags 114, is rounded, and the tags 114 having rounded recesses 119 to permit the arm members 111 to 113 to pivot relative to one another.

However, the amount of relative pivoting is restricted by stop means 119*a*provided, in this example, by engagement between a side edge E' of the arm member and the edge of the recess 119 of the tag 114.

Any alternate stop means to restrict the amount of relative pivoting could alternatively be provided. For example, the arm members 111–113 may be provided with formations extending upwardly or downwardly from the general plane of the arm members 111–113 which abut when the arm members 111–113 are in preferred transverse relationship to the next adjacent arm member 111–113.

The end arm members 111 and 112 are similarly constructed to one another, but being oppositely orientated, but arm member 111 has a pivot pin 118' which is adapted to be gripped by a clip 120 (see FIG. 11) provided on a mounting part 115 of an end member of another similar device to permit the devices to be connected together. In FIG. 11 clip 120 and member 112 are shown connected to a pivot pin 118' of a further end member 111' of another device 110'. Any desired number of devices 110,110' can thus be connected together to provide to a road vehicle halting apparatus of any desired extent.

The clips 120 each comprise a sliding part 121 including a pair of resiliently biased arms 122*a*,122*b*, which are adapted to be engaged around the pivot pin 118' of the next device 110'. The pivot pin 118' preferably has a groove in which the edges of the arms 122*a*,122*b*, are received.

It will be appreciated that when the arm members 111 to 113 are closed relative to one another, juxtaposed edges 25,26, thereof abut.

Each of the arm members 111 to 113 has attached to an upper surface 127 thereof, a plurality of support elements comprising cups 128.

The cups 128 and the member in which they are mounted on the arm members, may be substantially as described above with reference to FIGS. 1 to 9. The cups 128 may each receive an upwardly extending spike, which may be constructed as described with reference to FIGS. 1 to 9.

Again, in use, the device 110 is laid across a road in an open condition with the spikes supported by the clips 128 extending upwardly, and road engaging formations, such as downwardly extending spikes of fasteners 132 extending downwardly into engagement with the ground. In the event that a vehicle is driven over the device 110, and a tyre of the vehicle impinges upon an upwardly extending spike, the spike will be removed from its cup 128 and become embedded in the vehicle tyre as the tyre rotates.

At the same time, the downwardly depending spikes of fasteners 32 which extend downwardly from the device 10, will be driven into the ground, at least in the regions of the device where the vehicle wheels pass over the device 10. Thus any tendency for the device to migrate over the surface of the road is reduced.

The device 110 of FIGS. 10 and 11 may be used in combination with a deployment apparatus, similar to that shown in FIG. 9.

If desired, in any of the embodiments so far described, the road handling device 10, 110, may be provided with handles, as indicated at H in FIG. 10, to facilitate deployment. Preferably such handles are provided on some only of the arm members and do not extend upwardly from the arm members a significant distance, so as not to interfere with operation of the device.

Referring to FIG. 12 a modified form of arm member 211 is illustrated, which may be drawn or extruded for examples only, to the configuration shown, which is a channel configuration, there being a base 220 which mounts a plurality of support elements 228 each comprising a cup, which in turn each support an upwardly extending spike 240, there being a plurality of downwardly extending road engaging formations 232, again comprising spikes.

Integral with the base 228 are a pair of side limbs 221, 222, each angled relative to the base 220 at more than 90°.

The purpose of the limbs 221,222, is to engage with an approaching vehicle tyre and cause the arm 211 to rotate slightly so as to point the spikes towards the vehicle tyre and assist the spikes 240 puncturing the tyre.

To enable a road halting device having such arm members 211 to be folded up, with arm members lying alongside one another, preferably the limbs 221, 222, are castellated as indicated in FIG. 13, so that the castellations of the limbs 221 of one arm member 211*a* can interlope with the castellations of the limbs 222 of the other member 221*b*. Other arrangements are no doubt possible.

In FIG. 13, it can be seen that there are parts of the base 220 of one of the arm members 221*b* deformed downwardly out of the general plane of the base 220, to provide an alternative form of road engaging formation, namely a serration to the downwardly extending spikes 232.

I claim:

1. A mad vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that the in the event of a vehicle driving over the device, at least one of the formations digs into the ground, wherein the support member is provided with at least one portion deformed out of a general plane of the member towards the ground, which provides at least one of the road engaging formations which in use is driven into the ground to fix the device to the ground.

2. A device according to claim 1, wherein the at least one deformed portion includes one or more serrations which in the event of a vehicle driving over the device dig into the ground.

3. A device according to claim 1, wherein the at least one deformed portion comprises an edge part.

4. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that the in the event of a vehicle driving over the device, at least one of the formations digs into the ground, wherein the support member includes openings therethrough adapted to receive pins which in use are driven into the ground to fix the device to the ground.

5. A device according to claim 4, wherein the road engaging formations each comprise a part of a fastener which extends through the support member to secure a support element to an upper surface of the support member.

6. A device according to claim 4, wherein the road engaging formations comprise spikes.

7. A device according to claim 4, wherein each of the upwardly extending spikes include an external helical formation which, in use, becomes embedded in the tire of a vehicle which impinges upon the spike.

8. A device according to claim 4, wherein at least some of the support elements are attached to the device by respective fasteners which each includes a nut and each respective upwardly extending spike includes a formation which co-operates with the nut whereby the respective spike is supportable by its support element only in one or more specific axial orientations.

9. A device according to claim 4, wherein each of the upwardly extending spikes includes a non-round extending wall part which co-operates with a corresponding non-round hollow of its respective support element.

10. A device according to claim 4, wherein each of the upwardly extending spikes includes passage means to facilitate the passage of compressed air from a tire through a puncture caused by the spike in a controlled manner.

11. A device according to claim 4, wherein each of the upwardly extending spikes comprises one or more channels cut into an external wall of the spike.

12. A device according to claim 4, wherein the upwardly extending spikes each comprise a cylinder which is hollow and has a sharpened tip.

13. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the mad engaging formations each being configured so that the in the event of a vehicle driving over the device, at least one of the formations digs into the ground to thereby fix the device to the ground, wherein the support elements each comprise a plastic cup attached to an upper surface of the support member, the co-operation between cup and spike being such as to permit the spike readily to be released from a hollow of the cup when a vehicle tire impinges upon the spike, and wherein a washer is embedded in the plastic material to give the cup rigidity, the washer including an opening to receive a fastener which attaches the support element to the support member.

14. A device according to claim 13, wherein the washer is embedded in the plastic material adjacent a base of the cup which lies in contact with the support member on which the cup is mounted.

15. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that the in the event of a vehicle driving over the device, at least one of the formations digs into the ground, wherein the support elements comprise a plastic cup attached to an upper surface of the support member, the co-operation between cup and spike being such as to permit the spike readily to be released from a hollow of the cup when a vehicle tire impinges the spike, and wherein the cups and spikes have interengaging threaded formations so that the spikes are screwed into and out of their respective cups.

16. A device according to claim 15, wherein the helix angles of the interengaging threaded formations and the constructions of the spikes are such that when a vehicle is driven over the device and a spike becomes embedded in the vehicle tire, the spike is rotated and pulled and so is released from its threaded engagement with the cup.

17. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that the in the event of a vehicle driving over the device, at least one of the formations digs into the ground, wherein the device comprises a pair of generally elongate arm members each being pivotally connected at or adjacent at least one of its ends to a further generally elongate arm member of a further pair of arm members, at least one of the arm members comprising a support member, the arms of each pair being pivotally interconnected intermediate their respective ends, whereby the device is extendible from a closed position to an extended position by relatively pivoting the arm members, the arm members of one of the pairs of arm members of the device being adapted releasably to connect to opposite corresponding arm members of a similar device so as to provide a road vehicle halting device comprising a plurality of devices connected together, and wherein the arm members of one of the pairs each comprise a clip which engages with a pivot pin provided on the opposite corresponding arm member of the next device whereby the connected arm members are relatively pivotally connected together.

18. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that the in the event of a vehicle driving over the device, at least one of the formations digs into the ground, wherein the device comprises a pair of generally elongate arm members each being pivotally connected at or adjacent at least one of its ends to a further generally elongate arm member of a further pair of arm members, at least one of the arm members comprising a support member, and further comprises first and second generally elongate end arm members and at least one generally elongate intermediate arm member, at least one of the arm members comprising a support member, the or each intermediate arm member being connected by pivotal connections at or adjacent each of its ends to two further of the arm members whereby the device is extendible from a closed condition in which each of the arm members lie alongside one another to an open condition when at least some of the arm members lie transverse to one another, wherein when the device is in a closed condition juxtaposed edges of the arm members abut over at least substantially their entire extent, and each member comprises at one end, a generally transversely extending tag, the tag having a mounting part rigidly secured to it or integrally provided therewith whereby the end of the next arm member extends beneath and is pivotable relative to the mounting part.

19. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the mad engaging formations each being configured so that the in the event of a vehicle driving over the device, at least one of the formations digs into the ground to thereby fix the device to the ground, wherein the device comprises a pair of generally elongate arm members each being pivotally connected at or adjacent at least one of its ends to a further generally elongate arm member of a further pair of arm members, at least one of the arm members comprising a support member, and further comprises first and second generally elongate end arm members and at least one generally elongate intermediate arm member, at least one of the arm members comprising a support member, the or each intermediate arm member being connected by pivotal connections at or adjacent each of its ends to two further of the arm members whereby the device is extendable from a closed condition in which each of the arm members lie alongside one another to an open condition when at least some of the arm members tie transverse to one another, wherein when the device is in a closed condition each of the arm members lie in a generally common plane.

20. A road vehicle halting device comprising a support member, a plurality of support elements, means mounting the support elements on the support member, each supporting element supporting a generally upwardly extending spike, a plurality of downwardly extending mad engaging formations, means mounting the road engaging formations on the underside of the support member, the road engaging formations each being configured so that the in the event of a vehicle driving over the device, at least one of the formations digs into the ground to thereby fix the device to the ground, wherein the device comprises a pair of generally elongate am members each being pivotally connected at or adjacent at least one of its ends to a further generally elongate arm member of a further pair of arm members, at least one of the arm members comprising a support member, and further comprises first and second generally elongate end arm members and at least one generally elongate intermediate arm member, at least one of the arm members comprising a support member, the or each intermediate arm member being connected by pivotal connections at or adjacent each of its ends to two further of the arm members whereby the device is extendable from a closed condition in which each of the arm members lie alongside one another to an open condition When at least some of the arm members lie transverse to one another, wherein stop means are provided to prevent the arm members relatively pivoting beyond a fully open condition so that the device is extendible to the open condition by pulling one end member away from the other.

21. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member the road engaging formations each being configured so that the in the event of a vehicle driving over the device, at least one of the formations digs into the ground to thereby fix the device to the ground, wherein the device comprises a pair of generally elongate arm members each being pivotally connected at or adjacent at least one of its ends to a further generally elongate arm member of a further pair of arm members, at least one of the arm members comprising a support member, wherein the road engaging formations are secured at the pivotal connections between the arm members.

22. A road vehicle halting device comprising a support member, a plurality of support elements, means mounting the support elements on the support member, each supporting element supporting a generally upwardly extending spike, a plurality of downwardly extending road engaging formations, means mounting the road engaging formations on the underside of the support member, the road engaging formations each being configured so that the in the event of a vehicle driving over the device, at least one of the formations digs into the ground, wherein the device comprises a pair of generally elongate arm members each being pivotally connected at or adjacent at least one of its ends to a further generally elongate arm member of a further pair of arm members, at least one of the arm members comprising a support member, and further comprises a deployment apparatus comprising a chamber in which the device is received in a closed condition, there being a mouth from the chamber through which the device can be extended.

23. A combination according to claim 22, wherein the deployment apparatus includes a drawer having a pair of runners along which the ends of the arm members of the device run as the device is deployed.

24. A combination according to claim 22, wherein the deployment apparatus includes a handle to enable the device to be dragged over the ground during deployment of the device.

25. A combination according to claim 22, wherein the deployment apparatus includes rollers to facilitate dragging the apparatus over the ground.

* * * * *

UNITED STATES PATENT AND TRADEMARK OFFICE

CERTIFICATE OF CORRECTION

PATENT NO. : 5,536,109

DATED : July 16, 1996

INVENTOR(S) : ROY B.W. LOWNDES

It is certified that error appears in the above-indentified patent and that said Letters Patent is hereby corrected as shown below:

CLAIM 1, column 8, line 43, "mad" should be --road--.

CLAIM 13, column 9, line 47, "mad" should be --road--.

CLAIM 19, column 11, line 17, "mad" should be --road--.

CLAIM 20, column 11, line 42, "mad" should be --road--.

CLAIM 20, column 11, line 49, "am" should be --arm--.

Signed and Sealed this

Nineteenth Day of November, 1996

Bruce Lehman

*Attest:*

BRUCE LEHMAN

*Attesting Officer*

*Commissioner of Patents and Trademarks*